US010857451B2

(12) United States Patent
Rubin et al.

(10) Patent No.: US 10,857,451 B2
(45) Date of Patent: Dec. 8, 2020

(54) PAWN LAUNCHING GAME

(71) Applicant: CATCHUP TOYS LIMITED, Hong Kong (CN)

(72) Inventors: Guy Rubin, Hod Hasharon (IL); Avi Resch, Tel Aviv (IL)

(73) Assignee: CATCHUP TOYS LIMITED, San Po Kong (HK)

( * ) Notice: Subject to any disclaimer, the term of this patent is extended or adjusted under 35 U.S.C. 154(b) by 0 days.

(21) Appl. No.: 16/486,385

(22) PCT Filed: Feb. 8, 2018

(86) PCT No.: PCT/IB2018/050770
§ 371 (c)(1),
(2) Date: Aug. 15, 2019

(87) PCT Pub. No.: WO2018/150301
PCT Pub. Date: Aug. 23, 2018

(65) Prior Publication Data

US 2020/0001171 A1 Jan. 2, 2020

Related U.S. Application Data

(60) Provisional application No. 62/459,634, filed on Feb. 16, 2017.

(51) Int. Cl.
*A63F 7/24* (2006.01)
*A63F 7/00* (2006.01)

(52) U.S. Cl.
CPC ..... *A63F 7/2481* (2013.01); *A63F 7/2472* (2013.01); *A63F 7/0023* (2013.01)

(58) Field of Classification Search
USPC ..... 273/317
See application file for complete search history.

(56) References Cited

U.S. PATENT DOCUMENTS 2,563,969 A * 8/1951 Skinner ..... F41B 7/00 124/26
3,286,392 A * 11/1966 Fortunato ..... F41B 7/02 446/225
4,084,820 A * 4/1978 Olson, Jr. ..... A63B 65/122 124/56

(Continued)

FOREIGN PATENT DOCUMENTS

GB 2507234 A 4/2014

*Primary Examiner* — John E Simms, Jr.
*Assistant Examiner* — Dolores R Collins
(74) *Attorney, Agent, or Firm* — William Dippert; Laurence Greenberg; Werner Stemer

(57) ABSTRACT

A launcher (300) for pawns (666) comprising: a chamber comprising a base (110) and a muzzle situated opposite to each other, wherein the chamber is configured to be loaded with the pawn (666), via the muzzle; a magnet secured to the base (110); a bolt adapted to slide within the chamber to a loading position; a spring confined between the bolt and the base (110), wherein the spring is adapted to be squeezed; wherein by loading the pawn (666) into the chamber the bolt slide against the spring thereby squeeze the spring to the load position, wherein the bolt is configured to be retained in the load position, and wherein external impact break the magnetic field thus release the spring for driving the bolt toward the muzzle.

20 Claims, 6 Drawing Sheets

(56) References Cited

U.S. PATENT DOCUMENTS 4,335,878 A * 6/1982 Nishimiya ..... A63F 7/025 273/119 R
4,515,371 A * 5/1985 Basevi ..... A63F 3/00697 273/260
4,690,654 A * 9/1987 DeLaney ..... A63H 17/008 124/16
5,013,199 A * 5/1991 Downes ..... F16B 31/04 267/161
5,020,805 A * 6/1991 Fratangelo ..... A63F 3/00075 273/255
5,334,079 A * 8/1994 Gentile ..... A63H 27/14 446/308
5,390,653 A * 2/1995 Lee ..... A63B 65/12 124/1
5,511,793 A * 4/1996 Watt ..... A63F 3/00697 273/260
5,512,793 A * 4/1996 Takeuchi ..... B41J 2/14233 310/328
6,739,939 B2 * 5/2004 Matsukawa ..... A63F 3/00895 446/256
6,776,680 B2 * 8/2004 Chow ..... A63H 1/32 446/247
6,918,590 B2 * 7/2005 Annis ..... A63F 3/00697 273/142 H
6,988,927 B2 * 1/2006 Gingold ..... A63F 9/02 273/359
7,004,424 B1 2/2006 Pacchia
8,057,276 B2 * 11/2011 O'Connor ..... A63H 11/06 446/381
8,939,136 B2 * 1/2015 Gaus ..... F41F 7/00 124/4
9,514,254 B2 * 12/2016 Winfrey ..... G06F 30/20
9,782,666 B2 * 10/2017 Dahl ..... A63F 7/0017
2007/0205554 A1 * 9/2007 Elliott ..... A63F 9/16 273/126 R
2008/0190275 A1 * 8/2008 Tippmann ..... F41A 1/04 89/7
2011/0259310 A1 * 10/2011 Sopinsky ..... F41A 19/02 124/31
2012/0058706 A1 * 3/2012 Hudson ..... A63H 1/00 446/259
2012/0090586 A1 4/2012 Wood
2013/0143468 A1 * 6/2013 Raichman ..... A63F 9/24 446/484

* cited by examiner

PAWN LAUNCHING GAME

CROSS-REFERENCE TO RELATED PATENT APPLICATIONS

This patent application is a U.S. National Phase filing under 35 U.S.C. § 371 of PCT Patent Application No. PCT/IB2018/050770, filed Feb. 8, 2018, which is based upon and claims the priority of U.S. Provisional Patent Application Ser. No. 62/459,634, filed Feb. 16, 2017, each of which is incorporated herein by reference in its entirety.

TECHNICAL FIELD

The present disclosed subject matter relates to recreation games. More particularly, the present disclosed subject matter relates to non-electric game devices and methods for playing with such devices.

BACKGROUND

Children enjoy all sorts of games; however, children also have lots of energy and computer games don't involve much in the way of physical energy. It is also important to note that many have criticized the spread of computer games because they are usually played solo; thus, another important aspect of socializing by play is neglected. Parents, who want their kids to develop physically and socially, not just acquire rapid hand-eye coordination from shooting virtual monsters; encourage their kids to play traditional games. In fact, there is a bit of a backlash against computer and console gaming, for fear that too much computer and video gaming is unhealthy for children. Traditional game play is in a state of revival throughout the world, these games appeal because of their simplicity, fun to play, and how they allow kids to expend excess energy. Moreover, traditional game devices allow children to socialize and interact with their peers. Team games encourage cooperation and sharing as well. Childhood obesity, which is becoming more and more widespread, is strongly correlated to video game and TV use. It is desirable to induce interaction between children to develop their social skills and dexterity by an exciting game having a simple mechanism.

BRIEF SUMMARY

According to a first aspect of the present disclosed subject matter, a launcher for pawns comprising: a chamber comprising a base and a muzzle situated opposite to each other, wherein the chamber is configured to be loaded with the pawn, via the muzzle; a magnet secured to the base; a bolt adapted to slide within the chamber to a loading position; a spring confined between the bolt and the base, wherein the spring is adapted to be squeezed; wherein by loading the pawn into the chamber the bolt slide against the spring thereby squeeze the spring to the load position, wherein the bolt is configured to be retained in the load position, and wherein external impact break the magnetic field thus release the spring for driving the bolt toward the muzzle.

In some exemplary embodiments, the launcher is selected from a group consisting of a first launcher; and a second launcher, wherein the pawn is selected from a group consisting of a first pawn; and a second pawn; and wherein the first chamber is configured to be loaded with the first pawn and the second chamber is configured to be loaded with the second pawn.

In some exemplary embodiments, the bolt of the first launcher further comprises an object connected to the bolt on the side facing the base, wherein the object is selected from the group consisting of: magnets; steel; and a combination thereof; and wherein said the bolt is configured to be retained in the load position by generating a magnetic field with the magnet.

In some exemplary embodiments, the bolt of the second launcher have a trough-hole allowing a protrusive portion of the second pawn to penetrate the bolt while the portion face the base, wherein the portion is selected from the group consisting of: magnets; steel; and a combination thereof; and wherein said the bolt is configured to be retained in the load position by generating a magnetic field with the magnet.

The launcher of claim 1, wherein the base of the launcher is adapted to be retained to an external surface.

According to another aspect of the present disclosed subject matter, pawn launching game comprising: at least one launcher of claim 1; a plurality of pawns each adapted to be loaded into the launcher; at least two disks each having a base surface and an opposite sliding surface, wherein the disk is configured as a base when the base surface faces the floor alternatively the disk is configured as a diskater when the sliding surface faces the floor; wherein the base is configured to prevent the disk from sliding on the floor and retain the launcher on the sliding surface; wherein the diskater is configured to slide on the floor and impact, by collision, either the base or the launcher loaded with pawn; and wherein upon impact the launcher ejects the pawn.

In some exemplary embodiments, at least one of the disks is only adapted to be the base.

In some exemplary embodiments, another at least one of the disks is only adapted to be the diskater.

In some exemplary embodiments, the base further comprises at least one pad configured to prevent the base from sliding on the floor upon impact.

In some exemplary embodiments, the base is retained to the floor.

In some exemplary embodiments, the base further comprises at least one socket configured to accommodate the launcher.

In some exemplary embodiments, the socket further comprises a latch configured to retain the launcher to the socket.

In some exemplary embodiments, the base and the launcher are integral part.

In some exemplary embodiments, the launcher is secured directly to the floor.

According to yet another aspect of the present disclosed subject matter, a method for playing the pawn launching game of claims 6 to 14 by users selected from the group consisting of: a user, at least one opponent user, and a combination thereof, the method comprising: providing each user of the group with at least one launcher, at least one base, a plurality of pawns and a diskater; retaining the launcher to the base of each user; loading the launcher with the pawns of each user; deploying the base of each user in a strategic formation; sliding a diskater by the user for colliding with the base of the opponent user, wherein the colliding cause pawns to be ejected; catching as many ejected pawns in the air by the opponent user; reloading pawns which were caught in the air by the opponent user back to the launcher; and surrendering to the user pawns that fell on the floor.

In some exemplary embodiments, each user of the group of users take turns in said sliding the diskater, and wherein the wining user is a user of the group of users who collect all the pawns of the at least one opponent user.

In some exemplary embodiments, failing to catch a jocker pawn by the opponent user grants the user extra turn.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

In the drawings.

DETAILED DESCRIPTION

Figure 1:
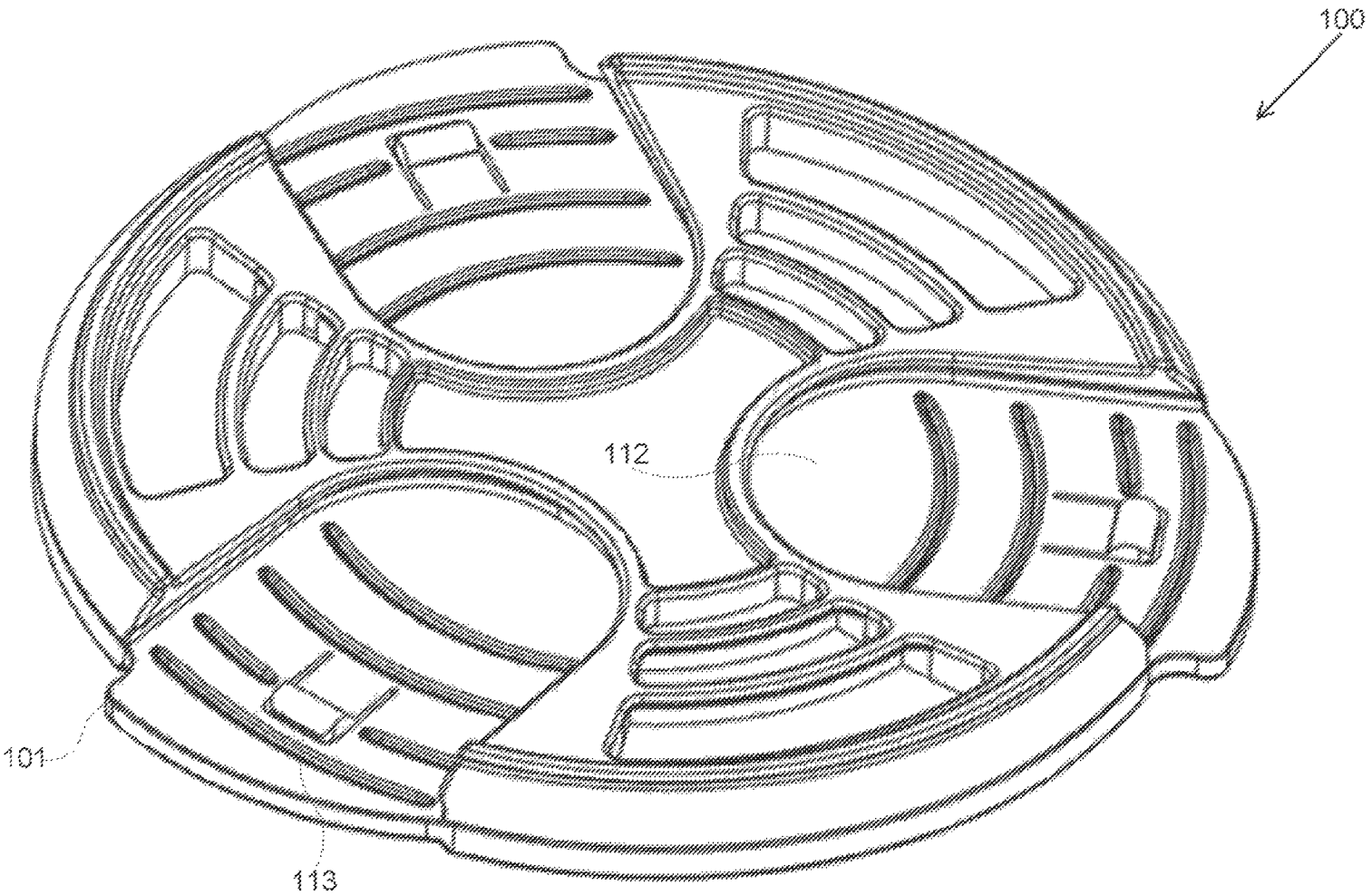
FIG. 1 shows a perspective view of a disk, having two surfaces, in accordance with some exemplary embodiments of the disclosed subject matter.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

The terms "comprises", "comprising", "includes", "including", and "having" together with their conjugates mean "including but not limited to". The term "consisting of" has the same meaning as "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this disclosed subject matter may be presented in a range format. It should be understood that the description in range format is merely for convenience and brevity and should not be construed as an inflexible limitation on the scope of the disclosed subject matter. Accordingly, the description of a range should be considered to have specifically disclosed all the possible sub-ranges as well as individual numerical values within that range.

It is appreciated that certain features of the disclosed subject matter, which are, for clarity, described in the context of separate embodiments, may also be provided in combination in a single embodiment. Conversely, various features of the disclosed subject matter, which are, for brevity, described in the context of a single embodiment, may also be provided separately or in any suitable sub-combination or as suitable in any other described embodiment of the disclosed subject matter. Certain features described in the context of various embodiments are not to be considered essential features of those embodiments, unless the embodiment is inoperative without those elements.

The present disclosure depicts an action surface such as floor or a table game that may comprise, a base, sliding disc, a launchers and collectable pawns inserted into at least one launcher. The game may combine strategies, competitiveness and dexterity. The launcher comprises a mechanism to receive and to hold the pawn until the launcher or the base upon which the launcher is placed are being hit by the sliding disk. Upon impact, the launcher mechanism may be triggered, which results in ejecting the pawn out from the launcher.

The base may be configured to hold at least one launcher and to maintain high friction with the floor by using rubber, silicone attached to the bottom of the base. Instead, the base may be secured to the floor on which it resides by any method known in the art. Additionally or alternatively, launcher may be configured to be attached directly to the floor. The sliding disk may be configured to slid over the floor, thereby having a low friction surface. The launcher may have a mechanism based on magnets, a spring, and a combination thereof to cause a pawn to be launched upon impact. A plurality of sliding discs, launchers, bases and pawns may be used in the game, which can cause a chain reaction by a disc hitting a base or a launcher and then deflected to hit another base or launcher.

Referring now to FIG. 1, showing a perspective view of disk 100, having two surfaces, in accordance with some exemplary embodiments of the disclosed subject matter. One surface of disk 100 may be used as a base surface, whereas the opposite surface may be used as a sliding surface.

It will be appreciated that, whenever the base surface of disk 100 faces the floor, on which it rests, the disk shall be utilized as a base and thus, the disk will be referred to, as base 110. It will be also appreciated that, whenever the sliding surface of disk 100 faces the floor, the disk may be utilized as a skater-disk and thus, the disk will be referred to, as diskater 120. It should be noted that, in such exemplary embodiments, diskater 120 and base 110 are opposite surfaces of disk 100. It should also be noted that a base surface maintains very high friction with the floor on which it rests, whereas the sliding surface maintains very low friction with the floor on which it rests.

In other exemplary embodiments, a disk may comprise two sliding surfaces or a plane surface and a sliding surface, and will be also referred to, as diskater 120. In yet other exemplary embodiments, a disk may comprise two base surfaces or a plane surface and a base surface, and will be also referred to, as base 110.

In some exemplary embodiments, the material from which disk 100, i.e. base 110 and diskater 120, is made may be any polymer, such as nylon, polyethylene, polyester, Teflon, polyurethane, epoxy, acrylonitrile butadiene styrene (ABS), polyvinyl chloride (PVC), any combination thereof, or the like. Additionally, or alternatively, base 110 and diskater 120 may be made of wood, cardboard, metal any combination thereof, or the like. In some exemplary embodiments, base 110 and diskater 120 may be produced in a process, such as injection molding, machining, blow molding, compression molding, extrusion molding, laminating, matrix molding, roto-molding, any combination thereof, or the like.

Figure 2A:
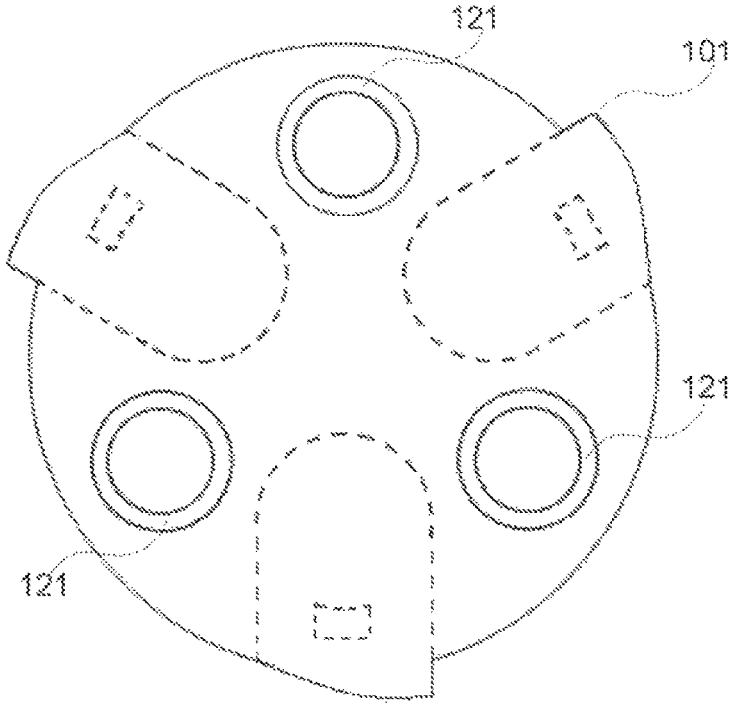
FIG. 2A depicts a schematic view of a base surface of the disk, in accordance with some exemplary embodiments of the disclosed subject matter.
Figure 2B:
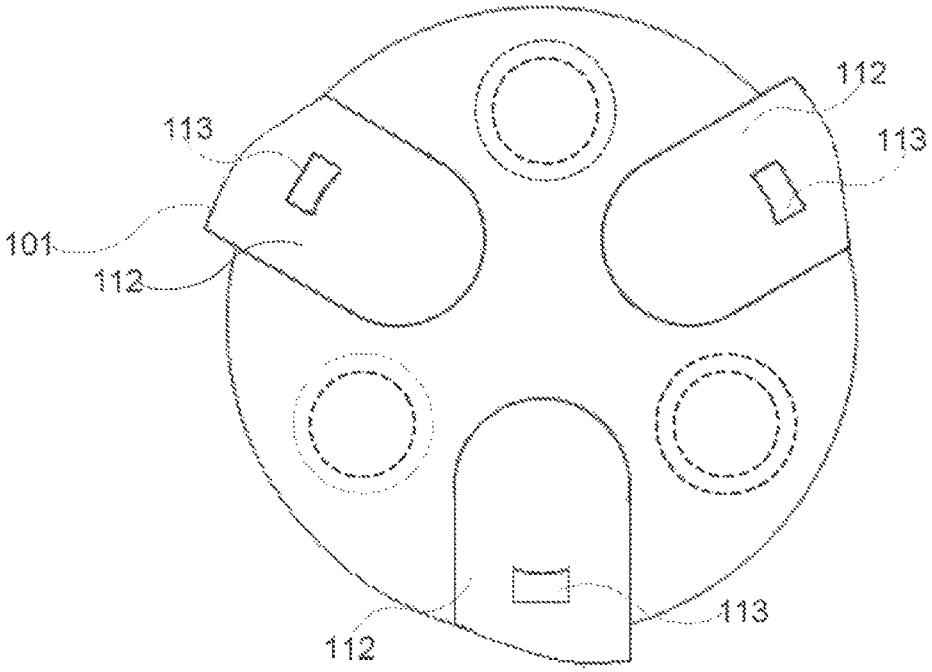
FIG. 2B depicts a schematic view of a sliding surface of the disk, in accordance with some exemplary embodiments of the disclosed subject matter.

Referring now to FIGS. 2A and 2B, depicting schematic views of the base surface and the sliding surface of disk 100, respectively; in accordance with some exemplary embodiments of the disclosed subject matter. The projection of both base and sliding surfaces may have a round shape with at least one protrusion 101, such as depicted in FIGS. 1, 2A and 2C. In other exemplary embodiments, both surfaces may have a circular shape, elliptical shape a polygon shape, any combination thereof, or any combination of a polygon and curves.

In some exemplary embodiments, the base surface may comprise at least one pad 121, adapted for contact with floor, whenever disk 100 is utilized as base 110. Pads 121 may be made of rubber, silicone, a combination thereof, or any other high friction material, configured to maintain high friction with the floor. In such exemplary embodiments, pads 121 are used to secure base 110 in position, whenever base 110 absorbs lateral impact from a sliding disk, such as diskater 120.

In some exemplary embodiments, sliding surface of disk 100 may comprise at least one socket 112 adapted to accommodate a launcher (to be described below), whenever disk 100 is utilized as base 110. Each socket 112 may comprise a latch 113 used to retain the launcher inside the socket 112.

Figure 3C:
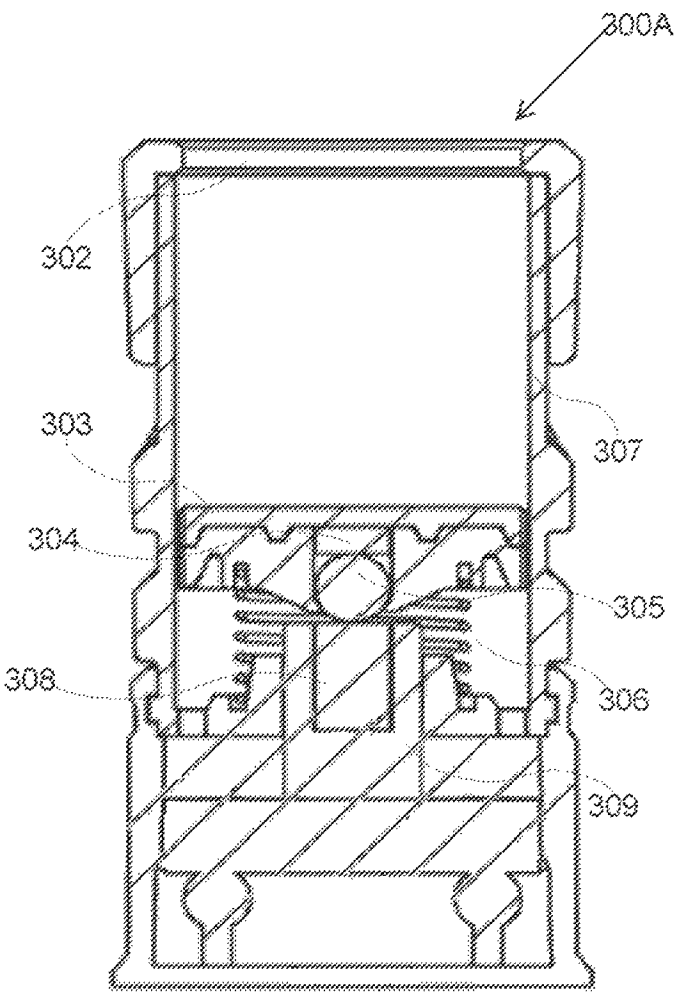
FIG. 3C shows a cross section view of the launcher in loaded state, in accordance with some exemplary embodiments of the disclosed subject matter.
Figure 3B:
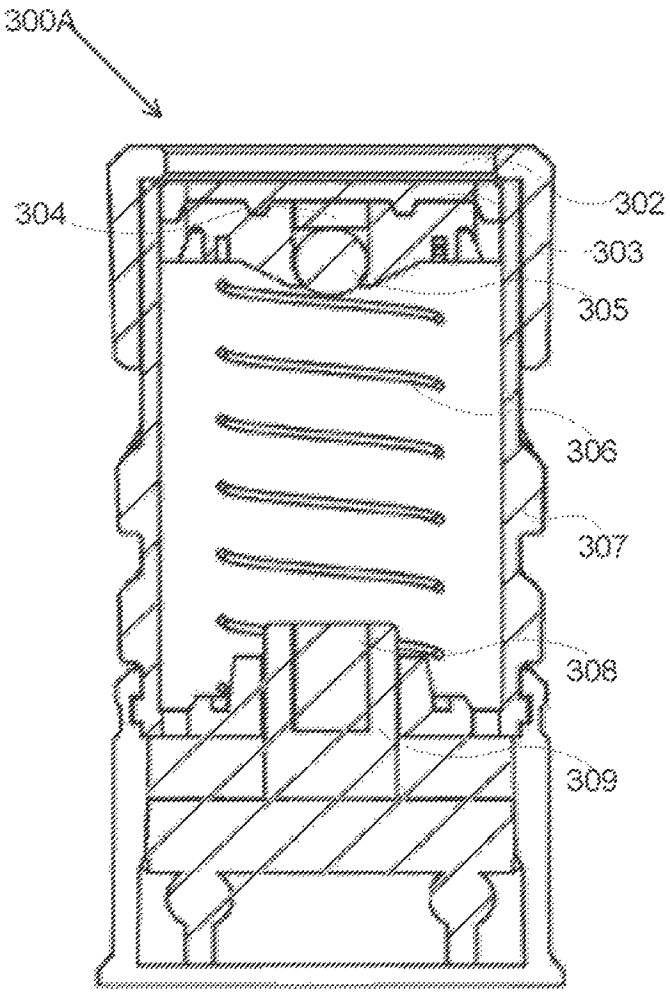
FIG. 3B shows a cross section view of the launcher in released state, in accordance with some exemplary embodiments of the disclosed subject matter.

Referring now to FIGS. 3B and 3C showing a cross section view of launcher 300 in a released state and a loaded state respectively, in accordance with some exemplary embodiments of the disclosed subject matter. Launcher 300 may be comprised of: muzzle 302, bolt 303, buffer 304, object 305, spring 306, chamber 307, magnet 308 and retainer 309.

In some exemplary embodiments, launcher 300A may have a cylindrical shape, whose inner part forms chamber 307, wherein magnet 308 may be permanently secured to a bottom of chamber 307 by retainer 309. Additionally, muzzle 302 is provided on top of launcher 300A to enable insertion of a pawn (to be described in detail further below) into the launcher. Bolt 303 may receive the pawn inserted into muzzle 302 and buffer 304 may be used to connect object 305 to the bottom of bolt 303. To load the launcher 300A, a pawn may be inserted, i.e. firmly pushed by a user, through muzzle 302, while pushing bolt 303 down in chamber 307, subsequently squeezing spring 306, against its tension, until object 305 kisses magnet 308, which is also the end of bolt 303 stroke. In some exemplary embodiments, the proximity between object 305 and magnet 308 generates a magnetic field between the two, wherein the magnetic field is sufficient to retain bolt 303 in a loaded position, even after the user cease the insertion.

In some exemplary embodiments, the following, launcher 300A, components: muzzle 302, bolt 303, buffer 304, spring 306, chamber 307 and retainer 309 may be made of materials, such as wood, cardboard, metal, polymers, any combination thereof, or the like. These components may be produced in a process, such as injection molding, machining, blow molding, compression molding, extrusion molding, laminating, matrix molding, roto-molding, any combination thereof, or the like. In some exemplary embodiments, both object 305 and magnet 308 may be magnets, or one of which may be a magnet, whereas the other may be made of steel or any other metal. Additionally, both object 305 and magnet 308 may each have different geometric shape, for example object 305 may have a ball shape and magnet 308 may have a cylindrical shape, such as depicted in FIGS. 3B and 3C. All the listed above components of launcher 300A may be assembled together to make a launcher, such as depicted in FIGS. 3B and 3C.

It should be mentioned that the object can be incorporated within the bolt or the bolt itself or a portion therein is made of a magnetic material or steel or metal so as to establish the magnetic field between the bolt and the magnet that is attached to the bottom of the launcher. Moreover, the bottom of the launcher can be made of magnetic material. None of these features limit the scope of the current subject matter.

It will be appreciated that, the magnetic field, between object 305 and magnet 308, delicately keep spring 306 shrunk. In some exemplary embodiments, sudden impact applied over the base of launcher 300A may assist spring 306 in breaking the magnetic field, which results in detaching object 305 and magnet 308 away from each other. Thus, ejecting the pawn outwardly through muzzle 302, away from the launcher and resetting the launcher 300A into released state.

Figure 3A:
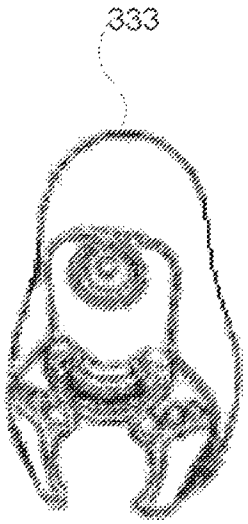
FIG. 3A shows an illustration of a pawn, in accordance with some exemplary embodiments of the disclosed subject matter.

Referring now to FIG. 3A showing an illustration of a pawn 333, in accordance with some exemplary embodiments of the disclosed subject matter.

A pawn 333 may be provided with the game to be used/played with the launcher 300A type. In some exemplary embodiments, pawn 333 may have form fit and weight that match the dimensions of the muzzle 302, chamber 307 and spring 306 properties, which enables launcher 300A to properly load and eject. Pawn 333 may be made of rubber, sponge, soft polymer, and any combination thereof, or other fluffy material. In some exemplary embodiments, the design of pawn 333 may vary in terms of image, color, marking, and any combination thereof, or the like. Additionally, or alternatively, pawn 333 can be designated as the joker pawn of the game, due to its special design.

Figure 4C:
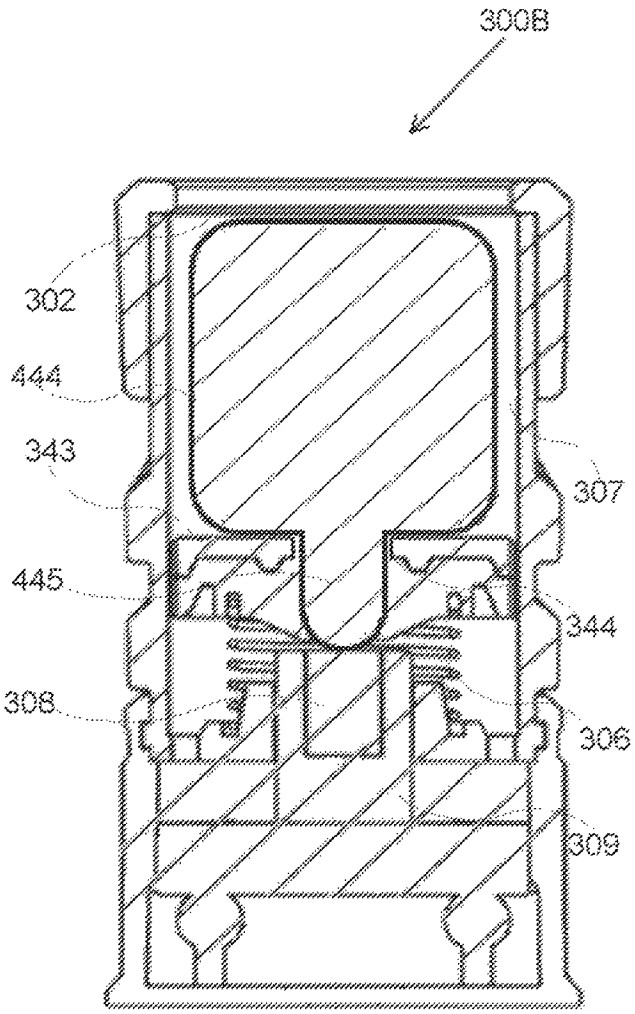
FIG. 4C shows a cross section view of the launcher in loaded state, in accordance with some exemplary embodiments of the disclosed subject matter.
Figure 4B:
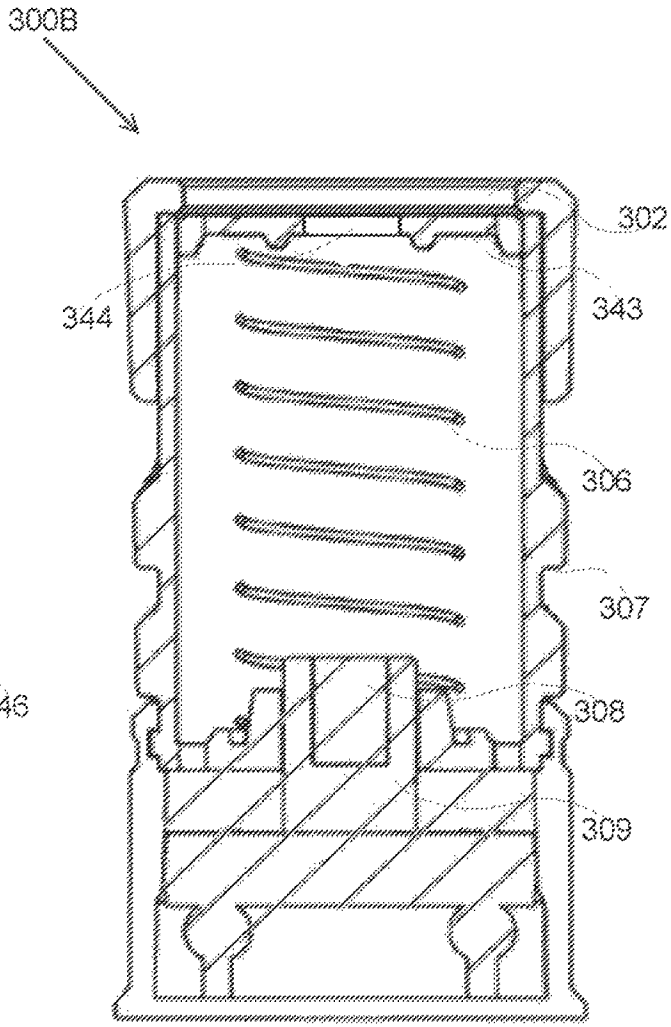
FIG. 4B shows a cross section view of the launcher in released state, in accordance with some exemplary embodiments of the disclosed subject matter.
Figure 4A:
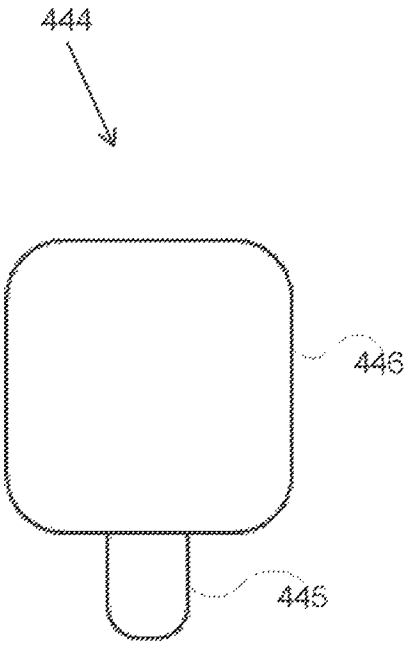
FIG. 4A shows an illustration of a pawn, in accordance with some exemplary embodiments of the disclosed subject matter.

Referring now to FIG. 4A showing an illustration of a pawn 444, in accordance with some exemplary embodiments of the disclosed subject matter.

A pawn 444 may be provided with the game to be used/played with the launcher 300B type. In some exemplary embodiments, pawn 444 may have form fit and weight that match the dimensions of the muzzle 302, chamber 307 and spring 306 properties, which enables launcher 300A to be properly loaded and ejected. Pawn 444 may be made of rubber, sponge, soft polymer, and any combination thereof, or other fluffy material.

In some exemplary embodiments of the disclosed subject matter, pawn 444 may have a shape allowing it to be loaded into chamber 300B type only, in one particular insertion way. Pawn 444 may comprise a body 446 and a portion 445, wherein the portion 445 or part of the portion 445 may be a magnetic material, such as a magnet, steel, metal, and a combination thereof, or the like. In some exemplary embodiments, portion 445 may be protruding away from body 446, alternatively, portion 445 may be flush with body 446.

Alternatively or additionally, the pawn 444 can be provided with particles of magnetic material or it whole can be made of a magnetic material.

Referring now to FIGS. 4B and 4C showing a cross section view of launcher 300B in a released state and a loaded state respectively, in accordance with some exemplary embodiments of the disclosed subject matter. Launcher 300B may be comprised of: muzzle 302, bolt 343, buffer 304, spring 306, chamber 307, magnet 308 and retainer 309.

In some exemplary embodiments, launcher 300B may have a cylindrical shape, whose inner part forms chamber 307, wherein magnet 308 may be permanently secured to a bottom of chamber 307 by retainer 309. Additionally, muzzle 302 is provided on top of launcher 300B to enable insertion of pawn 444 into the launcher.

In some exemplary embodiments, bolt 343 may have a through-hole adapted to enable the protrusive portion 445 of pawn 444 to penetrate the bolt 343 while bolt 343 receives an inserted pawn 444. To load the launcher 300B, a pawn 444 may be inserted, i.e. pushed by a user, through muzzle 302, while pushing bolt 343 down in chamber 307, subsequently shrinking spring 306, against its tension, until portion 445 kisses magnet 308, which is also the end of bolt 343 stroke.

In some exemplary embodiments, the proximity between portion 345 and magnet 308 generates a magnetic field between the two, wherein the magnetic field is sufficient to retain bolt 343 in a loaded position, even after the user cease the insertion.

alternatively, bolt 343 may be substantially ridged, however thin enough to enable sufficient magnetic field between magnet 308 and portion 445, wherein portion 445 of pawn 444 may be flush with body 446, such as one of the pawn 444 embodiment, previously described.

In some exemplary embodiments, the following, launcher 300B, components: muzzle 302, bolt 343, buffer 304, spring 306, chamber 307 and retainer 309 may be made of materials, such as wood, cardboard, metal, polymers, any combination thereof, or the like. These components may be produced in a process, such as injection molding, machining, blow molding, compression molding, extrusion molding, laminating, matrix molding, roto-molding, any combination thereof, or the like. In some exemplary embodiments, both portion 345 and magnet 308 may be magnets, or one of which may be a magnet, whereas the other may be steel. Additionally, both portion 345 and magnet 308 may each have different geometric shape, for example object 305 may have a ball shape and magnet 308 may have a cylindrical shape, such as depicted in FIGS. 4B and 4C. All the listed above components of launcher 300B may be assembled together to make a launcher, such as depicted in FIGS. 4B and 4C.

It will be appreciated that, the magnetic field, between portion 345 and magnet 308, delicately keep spring 306 shrunk. In some exemplary embodiments, sudden impact applied over the base of launcher 300B may assist spring 306 in breaking the magnetic field, which results in detaching portion 345 and magnet 308 away from each other. Thus, ejecting the pawn, trough muzzle 302, away from the launcher and resetting the launcher 300B into released state.

In some exemplary embodiments, pawns 444 design may vary in terms of image, color, marking, and any combination thereof, or the like. For example, pawn 444 may have a design indicating it as a "joker".

Figure 5A:
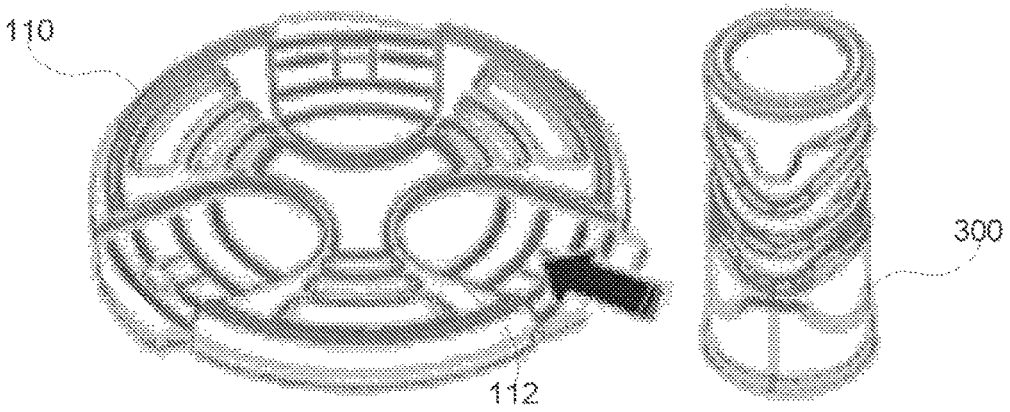
FIG. 5A shows a perspective view of a base and a launcher, in accordance with some exemplary embodiments of the disclosed subject matter.
Figure 5B:
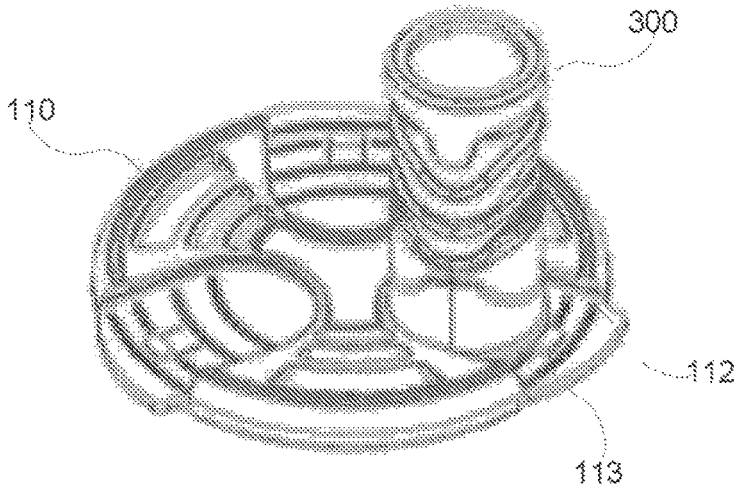
FIGS. 5B and 5C shows a perspective view of the launcher retained on a base, in accordance with some exemplary embodiments of the disclosed subject matter.
Figure 5C:
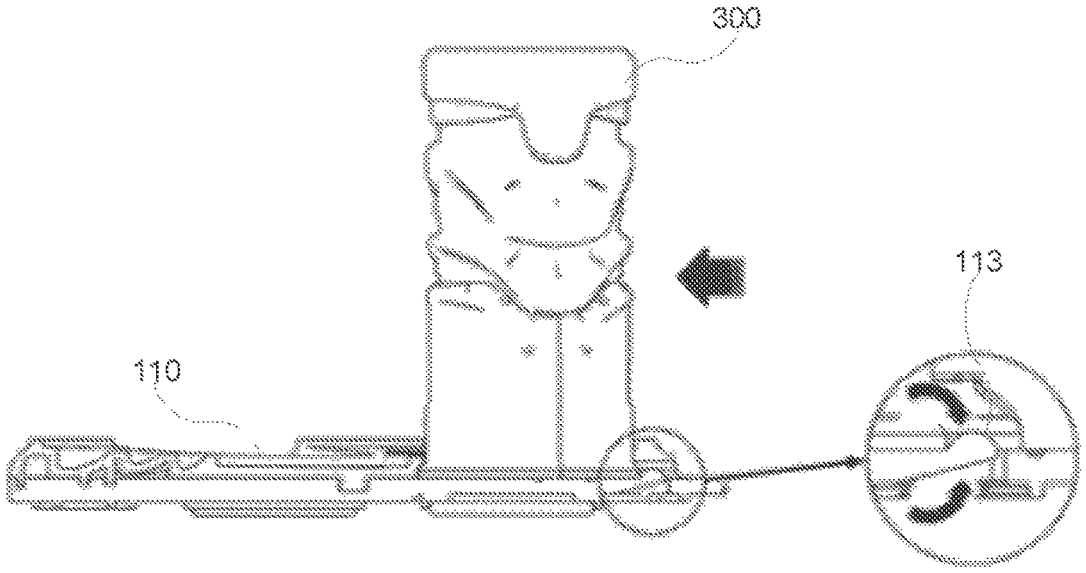

Referring now to FIGS. 5A-5C, showing a perspective view of a base 110 and a launcher 300, in accordance with some exemplary embodiments of the disclosed subject matter.

It should be noted that, launcher 300 depicted in FIGS. 5A-5C can be either launcher 300A or launcher 300B, ergo launcher 300A type, launcher 300B type, and a combination thereof, may be used in the pawn launching game. It should also be noted that, at any given time of the game, base 110 may accommodate as many launchers, of any type (300A or 300B), as the number of sockets base 110 comprise. However, launcher 300A may be configured for using pawns 333, while launcher 300B may be configured for using only pawns 444.

FIGS. 5B and 5C, showing a perspective view of a launcher 300 retained on base 110, in accordance with some exemplary embodiments of the disclosed subject matter.

It will be noted that, latch 113 may be a spring-loaded latch enabling a user to lock the launcher in position by snapping the launcher into socket 112. The launcher may be released by pulling latch 113 backward. Latch 113 may be configured to avoid inadvertent falling of launcher 300 from base 110, particularly while the base is being hit by diskater 120. The bottom of the disc 100, comprising pads 121 to increase the friction with the floor over which it rests, thus forces applied by diskater 120 hitting base 110 may be projected to the retained launcher 300.

Figure 6A:
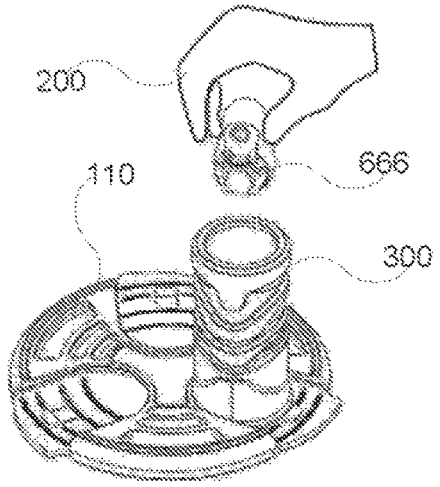
FIG. 6A illustrates loading a pawn into launcher retained on a base, in accordance with some exemplary embodiments of the disclosed subject matter.

Referring now to FIG. 6A, illustrating loading a pawn 666 into the launcher 300, by user 200, wherein the launcher 300 may be retained to base 110, in accordance with some exemplary embodiments of the disclosed subject matter.

Figure 6B:
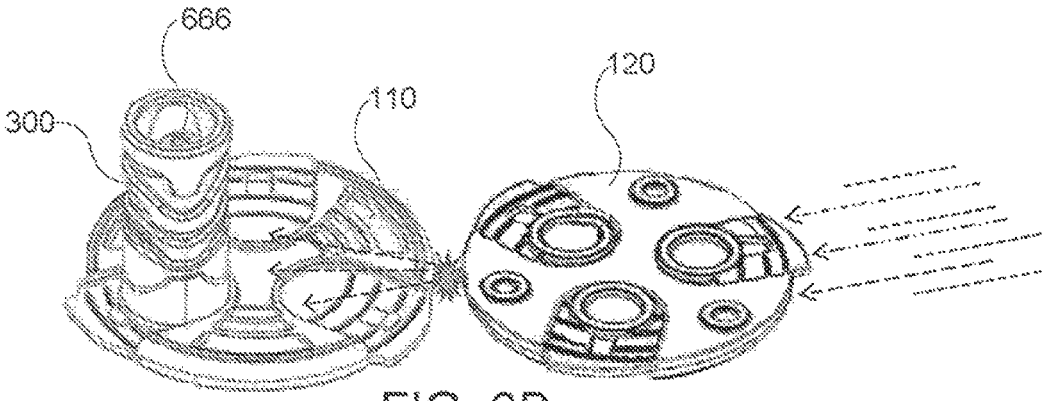
FIG. 6B illustrates a diskater colliding with a base, having launcher loaded with a pawn, in accordance with some exemplary embodiments of the disclosed subject matter.
Figure 6C:
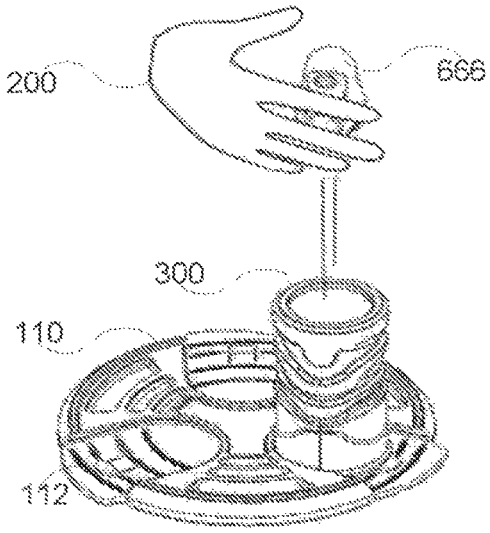
FIG. 6C illustrates a user catching a pawn ejected from the launcher, in accordance with some exemplary embodiments of the disclosed subject matter.

It will be appreciated that for convenience in describing FIGS. 6A-6C, both pawn 333 and pawn 444 are denoted as pawns 666 and both chamber 300A and chamber 300B are denoted as chamber 300. Yet, it is noted that pawn 333 can be used with chamber 300A, whereas pawn 444 can be used with chamber 300B Referring now to FIG. 6B, illustrating diskater 120 colliding with base 110, wherein base 110 has one launcher 300 loaded with pawn 666, in accordance with some exemplary embodiments of the disclosed subject matter. Upon the colliding of diskater 120 with base 110 lateral impact energy may be projected via base 110 towards launcher 300, thereby "triggering" (i.e. breaking the magnetic field) the launcher 300 to eject pawn 666. It should be noted that, most of the impact energy may be absorbed by base 110 and launcher 300, since pads 121 prevents base 110 from moving, i.e. high friction between pads 121 and the flor on which the base is residing. It should also be noted that, the "triggering" may be activated regardless of the angle by which diskater 120 collided with the base or the number launchers retained on the base. It should also be noted that, launcher 300 mechanism decreases the chances of inadvertent ejection of the pawn while the launcher is at rest.

Referring now to FIG. 6B, illustrating user 200 catching pawn 666 ejected from the launcher 300, in accordance with some exemplary embodiments of the disclosed subject matter. In other exemplary embodiments, all three sockets 112 of base 110, or part of them, may be populated with launchers 300. Thus, all the launchers will eject their pawns upon an impact caused by colliding diskater. In some exemplary embodiments, base 110 may comprise more than three sockets, each capable of accommodating a launcher.

In some exemplary embodiments of the disclosed subject matter, at least one launcher 300 and at least two disks 100 may be provided, wherein one disk 100 may be used as base 110 and the other as diskater 120. Since diskater 120 and base 110 are opposite surfaces of disk 100 (as previously said) the utilization of the provided disks 100 may be done by flipping one of disks 100 upside down.

Additionally, or alternatively, at least one launcher 300, at least one dedicated base 110 and at least one dedicated diskater 120 may be provided. In some exemplary embodiments, a dedicated base 110 may comprise two base surfaces or a plane surface (e.g. flat surface) and a base surface. And a dedicated diskater 120 may comprise two sliding surfaces or a plane surface and a sliding surface.

In some exemplary embodiments of the disclosed subject matter, the at least one launcher 300 may be an integral part of base 110 and may not be separable by the user. Additionally, or alternatively, one or more launchers may be secured directly to the floor without a need for a base such as base 110. Although references were made to at least two discs 100, launcher and pawn, it will be understood that several of each can be used by each player mutatis mutandis. Moreover, by using several discs, launchers and pawns, a chain reaction can be caused by a diskater 120 hitting a base 110 and then deflected to hit another base 110, thus causing several launchers to be triggered.

In some exemplary embodiments, the pawn launching game may be played by at least one user, wherein the objective of the user may be to ejects the pawns of his/her opponents, however the pawns must fall down on the floor. Each user in the game may have at least one base 110, at least one diskater 120, at least one launcher 300 and a plurality of pawns 400. However, the users may start the game with the same number bases, diskater, launcher and pawns.

Users may sit on the floor, at a distance ranging between 1 to 10 meters from one another and start retaining their at least one launcher on their at least one base and load them with pawns. Next the users may deploy their bases in a strategic formation of their choice. Following the deployment, a first user slides his/her diskater towards the formation of at least one opponent. If the diskater collide with the at least one opponent base and pawns ejected out of the launchers, the at least one opponent have to catch as many pawns as he or she can, before the pawns fall on the floor. The at least one opponent may reload the at least one launcher with caught pawns, however losing the pawns fell on the floor to the first user.

The method depicted above may be repeated for the second user, third user and so on. The user that first hits all of the remaining opponent's launchers thus causing all pawns remaining to be ejected and dropped on the floor wins the game and gets all the pawns. In some exemplary embodiments, a jocker pawn may be used. If at any time a joker was launched, the opponent having the launcher from which the jocker was ejected have to catch the jocker pawn. Otherwise the user who cause the jocker to eject, with his/her diskater, gets two turns in a row.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A pawn launching game comprising:

at least one launcher;

a plurality of pawns, each adapted to be loaded into the launcher;

at least two disks, each having a base surface and an opposite sliding surface, wherein the disk is configured as a base when the base surface faces a surface or the disk is configured as a diskater when the sliding surface faces the surface, wherein the base is configured to prevent the disk from sliding on the surface and retain the launcher on the sliding surface, wherein the diskater is configured to slide on the surface and impact, by collision, either the base or the launcher loaded with pawn, and wherein, upon impact, the launcher ejects the pawn.

2. The game of claim 1, wherein at least one of the disks is only adapted to be the base.

3. The game of claim 2, wherein the base further comprises at least one pad configured to prevent the base from sliding on the surface upon impact.

4. The game of claim 2, wherein the base is retained to the surface, and wherein the base further comprises at least one socket configured to accommodate the launcher.

5. The game of claim 4, wherein the socket further comprises a latch configured to retain the launcher to the socket.

6. The game of claim 1, wherein another at least one of the disks is only adapted to be the diskater.

7. The game of claim 1, wherein the base and the launcher are integral part.

8. The game of claim 1, wherein the launcher is secured directly to the surface.

9. The game of claim 1, wherein the surface is floor.

10. The game of claim 1, wherein the launcher comprises:

a chamber having a bottom and a muzzle situated opposite to each other, wherein the chamber is configured to be loaded with the pawn, via the muzzle;

a bolt adapted to slide within the chamber to a load position; and a spring confined between the bolt and the bottom, wherein the spring is adapted to be squeezed and released, wherein by loading the pawn into the chamber, the bolt is forced to slide against the spring that is squeezed, thus configured to be retained in the load position, and wherein external impact on the launcher releases the spring from the load position for driving the bolt towards the muzzle and the pawn externally through the muzzle.

11. The game of claim 10, wherein the launcher further comprises a magnet that is secured to the bottom and wherein a magnetic field retains the bolt in the load position and wherein the external impact breaks the magnetic field, thus releasing the bolt.

12. The game of claim 10, wherein the bottom of the launcher is configured to be retained to an external surface.

13. The game of claim 11, wherein the bolt comprises material selected from the group consisting of magnets, steel, metal, and a combination thereof, and wherein the bolt is configured to be retained in the load position by a magnetic field that is generated between the bolt and the magnet.

14. The game of claim 11, wherein the bolt comprises an object that is selected from the group consisting of magnets, steel, metal, and a combination thereof, and wherein the bolt is configured to be retained in the load position by a magnetic field that is generated between the object and the magnet.

15. The game of claim 11, wherein the pawn has a portion selected from the group consisting of magnets, steel, metal, and a combination thereof and wherein the bolt is configured to be retained in the load position by a magnetic field that is generated between the portion and the magnet.

16. The game of claim 11, wherein the pawn is made of material selected from the group consisting of magnets, steel, metal, and a combination thereof and wherein the bolt is configured to be retained in the load position by a magnetic field that is generated between the pawn and the magnet.

17. A method for playing a pawn launching game by users selected from the group consisting of a user, at least one opponent user, and a combination thereof, wherein the game comprises at least one launcher; at least one base; a plurality of pawns; and at least one diskater, the method comprising:

providing each user of the group with at least one launcher, at least one base, a plurality of pawns and a diskater;

retaining the launcher to the base of each user;

loading the launcher of each user with a pawn;

deploying the base of each user in a strategic formation;

sliding a diskater by the user for colliding with the base of the opponent user in order to cause pawns to be ejected;

catching as many ejected pawns in the air by the opponent user;

reloading pawns which were caught in the air by the opponent user back to the launcher; and surrendering pawns that fell on the floor to the user.

18. The method of claim 17, wherein each user of the group of users take turns in said sliding the diskater, and wherein a user that is a wining user is the user of the group of users who collects all the pawns of the at least one opponent user.

19. The method of claim 17, wherein failing to catch a j ocker pawn by the opponent user grants the user extra turn.

20. The method of claim 17, wherein the pawn launching game comprises:

at least one launcher;

a plurality of pawns, each adapted to be loaded into the launcher;

at least two disks, each having a base surface and an opposite sliding surface, wherein the disk is configured as a base when the base surface faces a surface or the disk is configured as a diskater when the sliding surface faces the surface, wherein the base is configured to prevent the disk from sliding on the surface and retain the launcher on the sliding surface, wherein the diskater is configured to slide on the surface and impact, by collision, either the base or the launcher loaded with pawn, and wherein, upon impact, the launcher ejects the pawn.

* * * * *